US008927074B2

(12) United States Patent
Fu et al.

(10) Patent No.: US 8,927,074 B2
(45) Date of Patent: Jan. 6, 2015

(54) INKJET MEDIA

(75) Inventors: Xulong Fu, San Diego, CA (US); Xiaoqi Zhou, San Diego, CA (US); Lokendra Pal, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/982,449

(22) PCT Filed: Feb. 22, 2011

(86) PCT No.: PCT/US2011/025721

§ 371 (c)(1),
(2), (4) Date: Jul. 29, 2013

(87) PCT Pub. No.: WO2012/115626

PCT Pub. Date: Aug. 30, 2012

(65) Prior Publication Data

US 2013/0323440 A1 Dec. 5, 2013

(51) Int. Cl.

| | |
|---|---|
| ***B41M 5/00*** | (2006.01) |
| ***B41M 5/52*** | (2006.01) |
| ***B41M 5/50*** | (2006.01) |

(52) U.S. Cl.

CPC ..... *B41M 5/5218* (2013.01); *B41M 5/5227* (2013.01); *B41M 5/5245* (2013.01); *B41M 5/52* (2013.01); *B41M 5/508* (2013.01)

USPC ..... 428/32.3; 428/32.34; 428/704

(58) Field of Classification Search

CPC .... B41M 5/5218; B41M 5/52; B41M 5/5245; B41M 5/227

USPC ..... 428/32.3, 32.34, 704

See application file for complete search history.

(56) References Cited

U.S. PATENT DOCUMENTS

| | | | |
|---|---|---|---|
| 5,275,867 A | 1/1994 | Misuda et al. | |
| 5,500,668 A | 3/1996 | Malhotra | |

(Continued)

FOREIGN PATENT DOCUMENTS

| | | | |
|---|---|---|---|
| JP | 09 29056 A * | 11/1997 | ..... B41M 5/00 |
| JP | 09-290556 A | 11/1997 | |

(Continued)

OTHER PUBLICATIONS

Ghen Materials—MSDS—May 1, 2011.*

*Primary Examiner* — Betelhem Shewareged

(74) *Attorney, Agent, or Firm* — Van Cott, Bagley, Cornwall & McCarthy; Steven L. Nichols

(57) ABSTRACT

A method of producing inkjet media (170) includes dissolving heptahydrate epsomite in a coating solution comprising at least one surface sizing additive, coating at least one side of a substrate with the coating solution to produce the inkjet media (170). An inkjet medium (170) includes a substrate (172) and a coating layer (174) comprising heptahydrate epsomite deposited on a first side of the substrate, the coating layer (174) having a substantially uniform distribution of heptahydrate epsomite throughout its volume.

17 Claims, 7 Drawing Sheets

(56) References Cited

U.S. PATENT DOCUMENTS

| | | | | |
|---|---|---|---|---|
| 6,508,980 | B1 | 1/2003 | Sachs et al | |
| 6,841,205 | B1 | 1/2005 | Sismondi et al. | |
| 6,896,952 | B2 | 5/2005 | Calland | |
| 7,087,107 | B2 | 8/2006 | Tateishi et al. | |
| 7,569,255 | B2 | 8/2009 | Dannhauser et al. | |
| 2001/0012556 | A1 * | 8/2001 | Kondo et al. | 428/195 |
| 2002/0039639 | A1 | 4/2002 | Kondo et al. | |
| 2005/0221024 | A1 | 10/2005 | Teshima et al. | |
| 2006/0088672 | A1 * | 4/2006 | Totani et al. | 428/32.3 |

FOREIGN PATENT DOCUMENTS

| | | | |
|---|---|---|---|
| JP | 2000037951 | | 2/2000 |
| JP | 2007-185942 | A | 7/2007 |
| JP | 2008-238772 | A | 10/2008 |
| JP | 2010-221688 | A | 10/2010 |

* cited by examiner

INKJET MEDIA

BACKGROUND

Coatings or surface treatment on inkjet media help retain the inkjet inks on the media surface. Some inkjet media coatings or surface treatment compositions contain divalent metal salts such as calcium chloride or magnesium chloride. These divalent metal salt containing inkjet coatings or treatment compositions are deposited on the inkjet media in liquid form. However, fluids containing high concentrations of chloride ions can be corrosive. Mechanisms on a paper manufacturing line that are directly exposed to these liquid coatings are particularly susceptible to corrosion. Maintenance and replacement of these corroded mechanisms is expensive both in terms of replacement cost and downtime.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
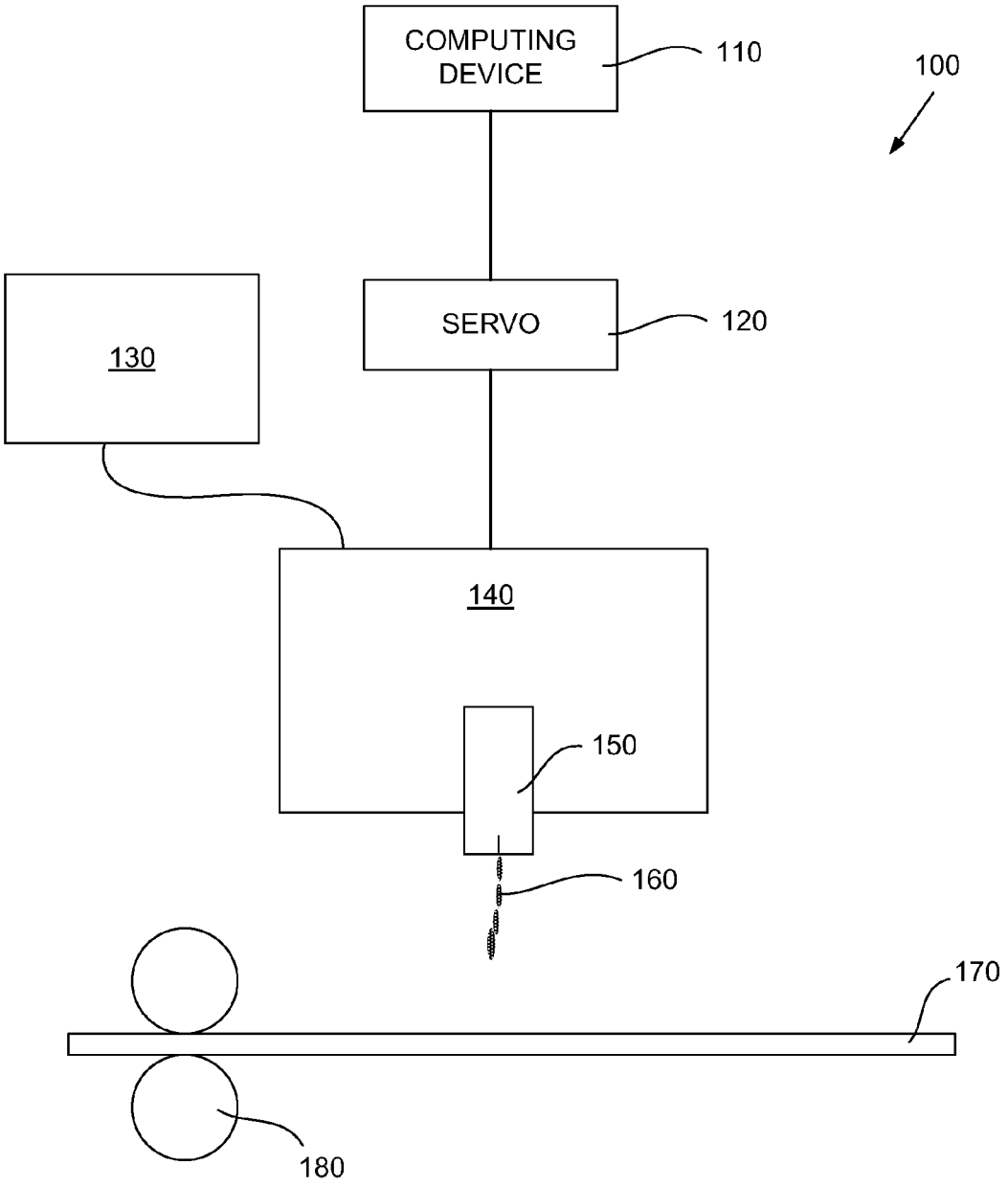
FIG. 1 is a diagram of an illustrative inkjet printing system, according to one example of principles described herein.

Coatings or surface treatment compositions on inkjet media help retain ink pigments on the media surface. Some inkjet media coatings or surface treatment compositions include divalent metal salts such as calcium chloride or magnesium chloride. These inkjet coatings or surface treatment compositions are deposited on the inkjet media in liquid form and dried. The divalent metal salts provide a number of advantages. One advantage is that the metal salts produce positively charged calcium or magnesium ions in the paper surface. These positively charged ions are very effective in attracting and holding negatively charged pigment particles in the inkjet ink. The charge based attraction between the calcium or magnesium ions and the pigment particles prevents bleed through, promote water fastness, and increase the optical density and color gamut of the printed image by holding more pigment particles near the visible surface of the of the printing media. Coating solutions or surface treatment compositions containing divalent chloride salts may have a pH between 7 and 9 or higher.

As discussed above, fluids containing high concentrations of chloride ions can be corrosive. Other factors that contribute to corrosion include pH values and temperatures of the liquid coatings. Mechanisms on a paper manufacturing line that are directly exposed to the liquid coatings or surface treatment compositions are particularly susceptible to corrosion. For example, many common metals such as carbon steel, cast iron, and stainless steels (302 SS, 304 SS, 316 SS, and 416 SS) are susceptible to corrosion by chloride ions. Maintenance and replacement of these corroded mechanisms is expensive both in terms of replacement cost and downtime.

It has unexpectedly been discovered that inkjet print quality on a surface treated inkjet medium can be substantially maintained while lowering amount of corrosion in manufacturing devices by substituting heptahydrate epsomite salt for all, or a part of the divalent metal salt in the surface treatment or coating.

Epsom salt is the common name for heptahydrate epsomite ($MgSO_4.7H_2O$). Heptahydrate epsomite salt readily dissolves in aqueous solutions to produce ions of magnesium and sulfate ($SO_4$). In some examples, aqueous surface treatment or coating solutions containing heptahydrate epsomite salt may have a pH of approximately 5 to 9. In one example, a coating solution containing epsom salt may have a pH of approximately 6 to 7. The sulfate ions are much less corrosive than chloride ions. However, their binding characteristics with ink pigments are similar to that of divalent metallic salts of chloride. This is demonstrated by higher ink optical density and lower bleed-through in printed images on inkjet mediums that have been coated or treated with heptahydrate epsomite salt.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of approximately 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc.

FIG. 1 illustrates an illustrative inkjet system (100) that may be used to apply a pigment-based inkjet ink (160) to an inkjet medium (170). As shown in FIG. 1, the present system includes a computing device (110) controllably coupled through a servo mechanism (120) to a moveable carriage (140) having an inkjet print head (150) disposed thereon. An ink reservoir (130) is coupled to the inkjet print head (150) through the moveable carriage (140). A number of rollers (180) are located adjacent to the inkjet dispenser (150) and selectively position an inkjet medium (170). The above-mentioned components of the system (100) will now be described in further detail below.

The computing device (110) that is controllably coupled to the servo mechanism (120), as shown in FIG. 1, controls the selective deposition of an inkjet ink (160) on an inkjet medium (170). A representation of a desired image or text may be formed using a program hosted by the computing device (110). That representation may then be converted into servo instructions that control the servo mechanisms (120) as well as the movable carriage (140) and inkjet dispenser (150). The computing device (110) illustrated in FIG. 1 may be, but is in no way limited to, a workstation, a personal computer, a laptop, a digital camera, a personal digital assistant (PDA), or any other processor containing device.

The moveable carriage (140) of the present printing system (100) illustrated in FIG. 1 is a moveable material dispenser that may include any number of inkjet material dispensers (150) configured to dispense the inkjet ink (160). The moveable carriage (140) may be controlled by a computing device (110) and may be controllably moved by, for example, a shaft system, a belt system, a chain system, etc. making up the servo mechanism (120). As the moveable carriage (140) operates, the computing device (110) may inform a user of operating conditions as well as provide the user with a user interface.

As an image or text is printed on the inkjet medium (170), the computing device (110) may controllably position the moveable carriage (140) and direct one or more of the inkjet dispensers (150) to selectively dispense an inkjet ink at predetermined locations on the inkjet medium (170) as digitally addressed drops, thereby forming the desired image or text. The inkjet material dispensers (150) used by the present printing system (100) may be any type of inkjet dispenser configured to perform the present method including, but in no way limited to, thermally actuated inkjet dispensers, mechanically actuated inkjet dispensers, electrostatically actuated inkjet dispensers, magnetically actuated dispensers, piezoelectrically actuated dispensers, continuous inkjet dispensers, etc. Additionally, the present inkjet medium (170) may receive inks from non-inkjet sources such as, but in no way limited to, screen printing, stamping, pressing, gravure printing, and the like.

The ink reservoir (130) that is fluidly coupled to the inkjet material dispenser (150) houses and supplies an inkjet ink (160) to the inkjet material dispenser. The ink reservoir (130) may be any container configured to hermetically seal the pigment-based inkjet ink (160) prior to printing.

FIG. 1 also illustrates the components of the present system that facilitate reception of the pigment-based inkjet ink (160) onto the inkjet medium (170). As shown in FIG. 1, a number of positioning rollers (180) may transport and/or positionally secure an inkjet medium (170) during a printing operation. Alternatively, any number of belts, rollers, substrates, or other transport devices may be used to transport and/or postionally secure the inkjet medium (170) during a printing operation.

The present system and methods provide a porous inkjet medium (170) with enhanced image quality, the composition of which will now be described in detail below.

Figure 2:
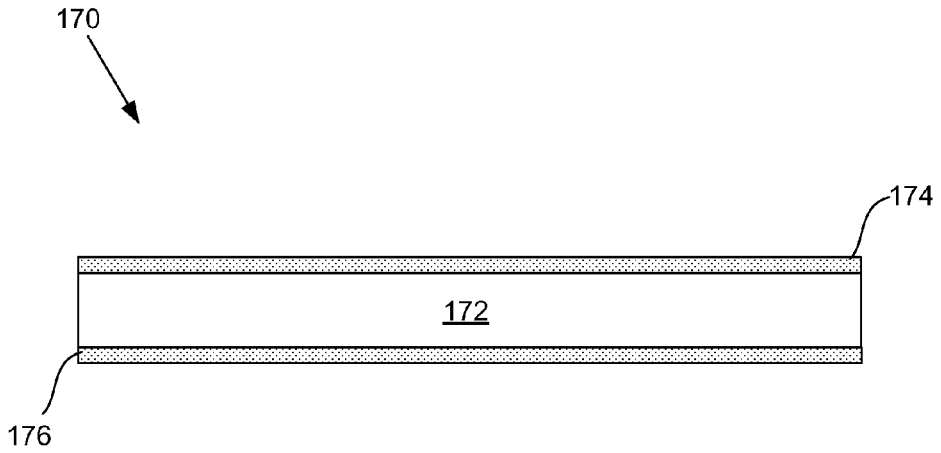
FIG. 2 is a side cross-sectional view showing the layers of an illustrative inkjet medium, according to one example of principles described herein.

The illustrative inkjet medium (170) configured to receive an inkjet ink (160) is illustrated in FIG. 2. As shown in FIG. 2, the inkjet medium (170) includes a substrate (172) that is surface treated on two sides with ink receiving layers (174, 176) containing heptahydrate epsomite salts and a sizing agent. As discussed above, epsom salt is the common name for heptahydrate epsomite ($MgSO_4.7H_2O$). Heptahydrate epsomite salt readily dissolves in aqueous solutions to produce ions of magnesium and sulfate ($SO_4$). An aqueous solution containing heptahydrate epsomite salt typically has a pH of 5-7. Thus, the aqueous solution is an acidic rather than alkaline. The sizing agent may include one or more of a starch, filler, or polymeric surface sizing composition.

The substrate (172) has a basis weight ranging from 35 to 250 grams per square meter (gsm), and from 5 to 35% by weight of filler. The filler may include, but is not limited to, calcium carbonate ($CaCO_3$), clay, kaolin, gypsum (hydrated calcium sulfate), titanium oxide ($TiO_2$), talc, alumina trihydrate, magnesium oxide (MgO), minerals, and/or synthetic and natural fillers. Inclusion of these above-mentioned fillers may reduce the overall cost of substrate (172) for some examples. Including white filler, such as calcium carbonate, may enhance the brightness, whiteness, and the quality of substrate (172).

The substrate (172) also includes mechanical pulp (groundwood pulp, thermomechanical pulp, and chemo-thermomechanical pulp), wood-free pulp, and/or non-wood fiber such as bagasse or bamboo. The substrate (172) may include sizing agents, e.g., metal salts of fatty acids and/or fatty acids, alkyl ketene dimer emulsification products and/or epoxidized higher fatty acid amides, alkenyl or alkylsuccinic acid anhydride emulsification products and rosin derivatives, dry strengthening agents, e.g., anionic, cationic or amphoteric polyacrylamides, polyvinyl alcohol, cationized starch and vegetable galactomannan, wet strengthening agents, e.g., polyaminepolyamide epichlorohydrin resin, fixers, e.g., water-soluble aluminum salts, aluminum chloride, and aluminum sulfate, pH adjustors, e.g., sodium hydroxide, sodium carbonate and sulfuric acid, optical brightening agents, and coloring agents, e.g., pigments, coloring dyes, and fluorescent brighteners.

The substrate (172) may include, but is not limited to, pigmented surface size paper, pigmented coated papers and cast-coated papers or surfaced super-calendared paper. These substrates (172) may be surface treated using a wide variety techniques. Additionally, the substrate (172) may include transparent films, cellulose esters, including cellulose triacetate, cellulose acetate, cellulose propionate, or cellulose acetate butyrate, polyesters, including poly(ethylene terephthalate), polyimides, polycarbonates, polyamides, polyolefins, poly(vinyl acetals), polyethers, polyvinyl chloride, diacetates, triacetates, polystyrenes, polyethylenes, polycarbonates, polymethacrylates, cellophane, celluloid, polyvinyl chlorides, polyvinylidene chlorides, polysulfones, and polysulfonamides. Further, opaque photographic materials may be used as the substrate (172) including, but in no way limited to, baryta paper, polyethylene-coated papers, and voided polyester.

As illustrated in FIG. 2, the substrate (172) is coated on at least one surface with a coating solution or a surface treatment composition containing heptahydrate epsomite salt. This coating solution or surface treatment composition is dried to form ink receiving layers (174, 176) that improve the optical density, color gamut, ink show-through, wicking, mottle, bleeding, bronzing, and dry time when ink is applied to the inkjet medium (170). The total dry coatweight of the ink receiving layer (174, 176) is about 0.5 to 10 grams per square meter of inkjet medium which contains 0.1 to 2.0 grams per square meter of heptahydrate epsomite salt. In one implementation, the total dry coatweight of an ink receiving layer is about 1 to 5 grams per square meter which contains 0.2 to 1.0 grams per square meter of heptahydrate epsomite salt. In some examples, the substrate surface is only coated or treated with one ink receiving layer. In other examples, the substrate surface is coated or treated with salt solution in water only. According to one illustrative example, the ink receiving layers (174, 176) may also comprise a divalent metal salt such as calcium or magnesium chloride, calcium or magnesium bromide, calcium or magnesium nitrate, and calcium or magnesium acetate. Where a divalent metal salt is added to the heptahydrate epsomite salt, the coating solution has a molar ratio of sulfate anions to chloride anions from about 5:1 to 1:1. This will minimize corrosion issues during paper manufacturing because sulfate is not an aggressive anion and acts as a corrosion inhibitor for chloride related pitting. The inhibiting effect is particularly pronounced if sulfate ions are present in molar excess over chloride ions. In one example, the weight percentage of the heptahydrate epsomite salt is more than 50% of total salts in the coating solution.

Figure 3:
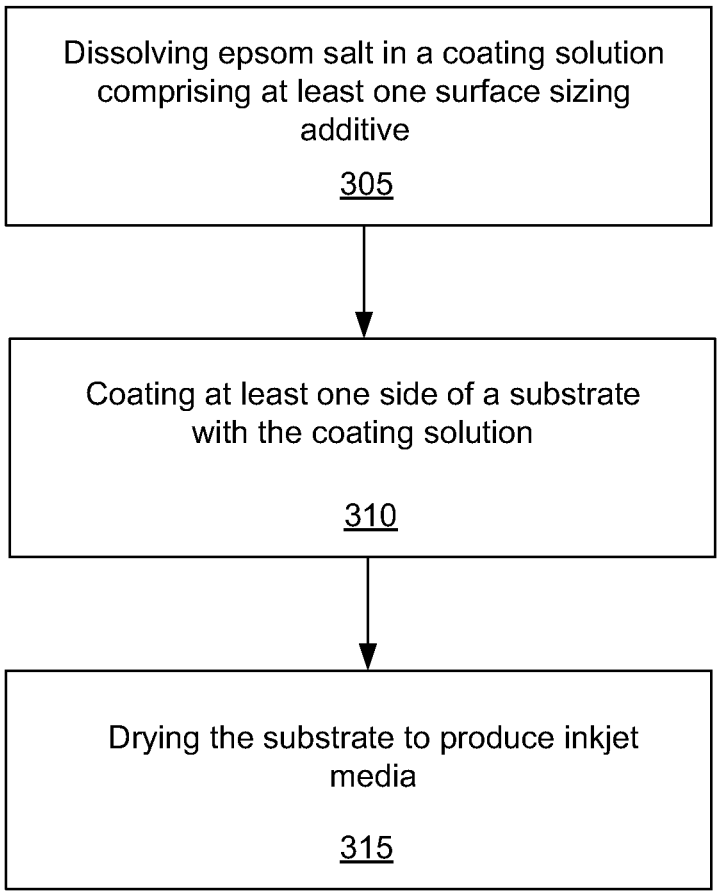
FIG. 3 is a flowchart showing an illustrative method for forming an inkjet medium, according to one example of principles described herein.

FIG. 3 is a flowchart showing an illustrative method for creating an inkjet media with ink receiving layers that include heptahydrate epsomite salt coatings. The method includes dissolving epsom salt in a coating solution comprising at least one surface sizing additive (block 305). The coating solution is mixed until it has a substantially uniform distribution of epsom salt throughout its volume. The coating solution is then applied to at least one side of the substrate (block 310). The coating solution or surface treatment composition may be applied onto the substrate by any number of material dispensing machines and/or methods including, but in no way limited to, puddle size press, metering size press in line with a paper machine or a off line coater such as a slot coater, a curtain coater, a cascade coater, a blade coater, a rod coater, a gravure coater, a Mylar rod coater, a wired coater, and the like. The coating solution is dried by infra red heaters, hot air, or other appropriate technology to produce an ink receiving layer on the inkjet media (block 315) that has a substantially uniform distribution of heptahydrate epsomite salt throughout its volume.

In some implementations, other forms of magnesium sulfate could be used instead of heptahydrate epsomite salts. For example, anhydrous, monohydrate, tetrahydrate, pentahydrate, and heptahydrate forms of magnesium sulfate could be used. However, these forms of magnesium sulfate may not dissolve as easily as heptahydrate epsomite salt. This can be remedied by hydrating the magnesium sulfate prior to or during mixing. In some examples, dispersing technologies can be used to make magnesium sulfate form a stable aqueous solution that is mixed with coating or surface treatment compositions.

Figure 4:
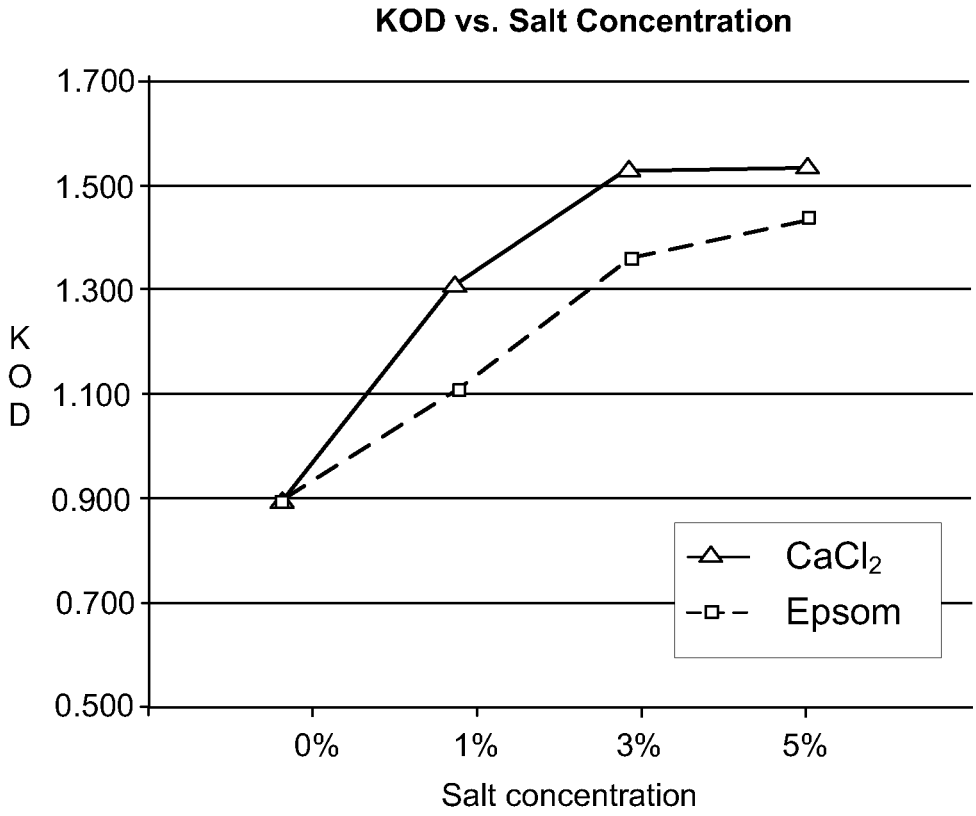
FIG. 4 is a graph showing optical density versus salt concentration for an illustrative inkjet medium coated with calcium chloride and an inkjet medium coated with heptahydrate epsomite (epsom) salt, according to one example of principles described herein.

FIG. 4 is a graph showing optical density versus salt concentration for an inkjet media coated with calcium chloride and an illustrative ink jet media with epsom salt. Optical density is the color density as measured by a change in reflectance.

$$OD = \log_{10}\left[\frac{I_i}{I_r}\right] \quad \text{Eq. 1}$$

where OD is the optical density, $I_i$ is the incident light intensity and $I_r$ is the reflected light intensity. Higher optical density values are more desirable.

The vertical axis of the graph shows the optical density of black ink (KOD) starting at 0.500 and going to 1.700. The horizontal axis shows the salt concentration in the ink receiving layer, with the balance being a sizing agent. The optical density of ink printed on two different inkjet mediums is shown: an inkjet medium surfaced treated with calcium chloride ($CaCl_2$) and an inkjet medium surface treated with heptahydrate epsomite salt. The optical density measurements of the inkjet medium surface treated with calcium chloride are shown as triangles connected by a solid line. The optical densities of the inkjet medium surface treated with varying concentrations of heptahydrate epsomite salt are shown as squares connected by a dashed line.

Where the salt concentration is 0%, only starch and filler are present in the ink receiving layer. In this situation, both inkjet mediums had an optical density of 0.900. With a one percent salt concentration, the calcium chloride inkjet treated medium had an optical density of about 1.300, while the heptahydrate epsomite salt treated inkjet medium had an optical density of about 1.100. At 3% salt concentration, the calcium chloride treated inkjet medium had an optical density of a little over 1.500, while the heptahydrate epsomite salt treated inkjet medium had an optical density of about 1.350. At 5% salt concentration, the calcium chloride treated inkjet medium had an optical density of a little over 1.500, while the heptahydrate epsomite salt treated inkjet medium had an optical density of about 1.450.

This data shows that at low salt concentrations, calcium chloride coating results in a higher optical density than the heptahydrate epsomite salt. However, as the salt concentration increases, the difference between the calcium chloride and heptahydrate epsomite salt is significantly reduced.

Figure 5:
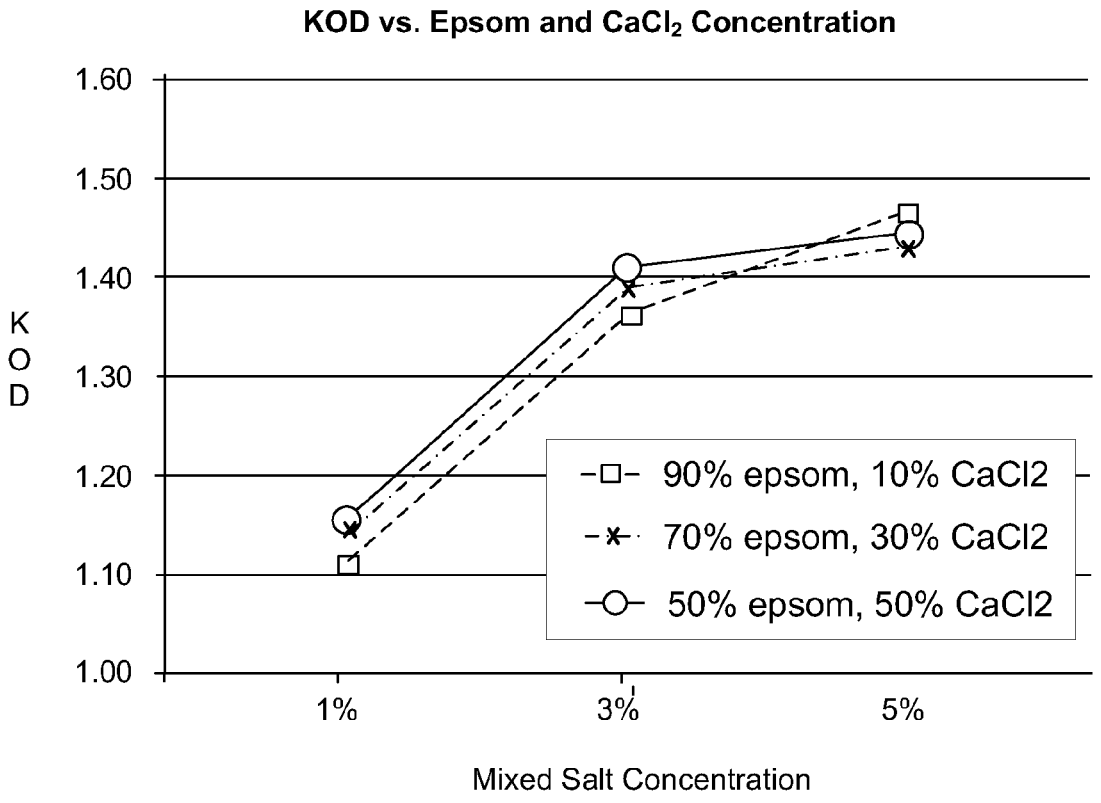
FIG. 5 is a graph showing optical density of black ink on inkjet papers coated with mixtures of heptahydrate epsomite salt and calcium chloride, according to one example of principles described herein.

FIG. 5 is a graph showing optical density of black ink on inkjet paper surfaces treated with varying mixtures of heptahydrate epsomite salt and calcium chloride. The vertical axis of the graph shows optical densities starting at 1.00 and going up to optical densities of 1.60. The horizontal axis shows mixed salt concentrations of 1%, 3%, and 5%.

A first mixture includes 90% epsom salt and 10% calcium chloride. The optical density data for pigment based black ink printed on a paper surface treated with the first mixture is shown as open squares connected by dashed lines. The optical density for the first mixture rapidly increases from 1.10 to 1.37 as the mixed salt concentration increases from 1% to 3%. The first mixture has the highest optical density in the data set at 5% mixed salt concentration.

A second mixture includes 70% epsom salt and 30% calcium chloride. The optical density data for pigment based black ink printed on a paper surface treated with the first mixture is shown with "X" shaped marks connected by dash-dot lines. The second mixture has a slightly higher optical density at 1% and 3% mixed salt concentration than the first mixed salt concentration. However, the second mixture has an optical density is slightly lower than the first mixture at 5%.

A third mixture includes 50% epsom salt and 50% calcium chloride. The optical density data for black ink printed on a paper surface treated with the third mixture is shown with circles connected by a solid line. The third mixture has the highest optical density at low salt concentrations, but has a slightly lower optical density than the first mixture at 5% mixed salt concentration.

Figure 6:
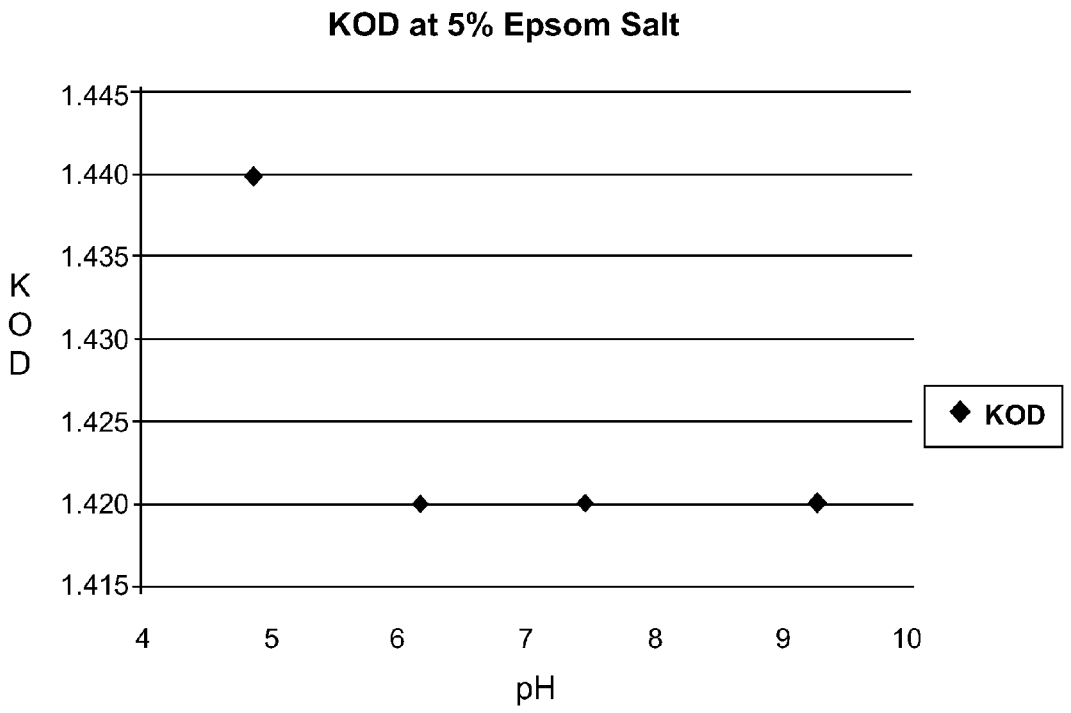
FIG. 6 is a graph showing the optical density of black ink on inkjet papers coated with epsom salt with varying pH, according to one example of principles described herein.

FIG. 6 is a graph showing the optical density of pigment based black ink on inkjet papers coated with 5% epsom salt with varying pH. The vertical axis shows a narrow range of optical densities starting at 1.415 and going up to optical densities of 1.445. The horizontal axis shows a range of pH values starting at 4 and going up to 10. For an inkjet paper surface treated with 5% heptahydrate epsomite salt with a pH of 5, the optical density of black ink is 1.44. For inkjet paper surface treated with 5% heptahydrate epsomite salt coatings with pH values of about 6.2, 7.5, and 9.3, the optical densities are 1.42. This data shows that a wide range of pH values could be in combination with heptahydrate epsomite salt. For example, the coating solution may have a pH in the range of approximately 6 to 7.

Figure 7:
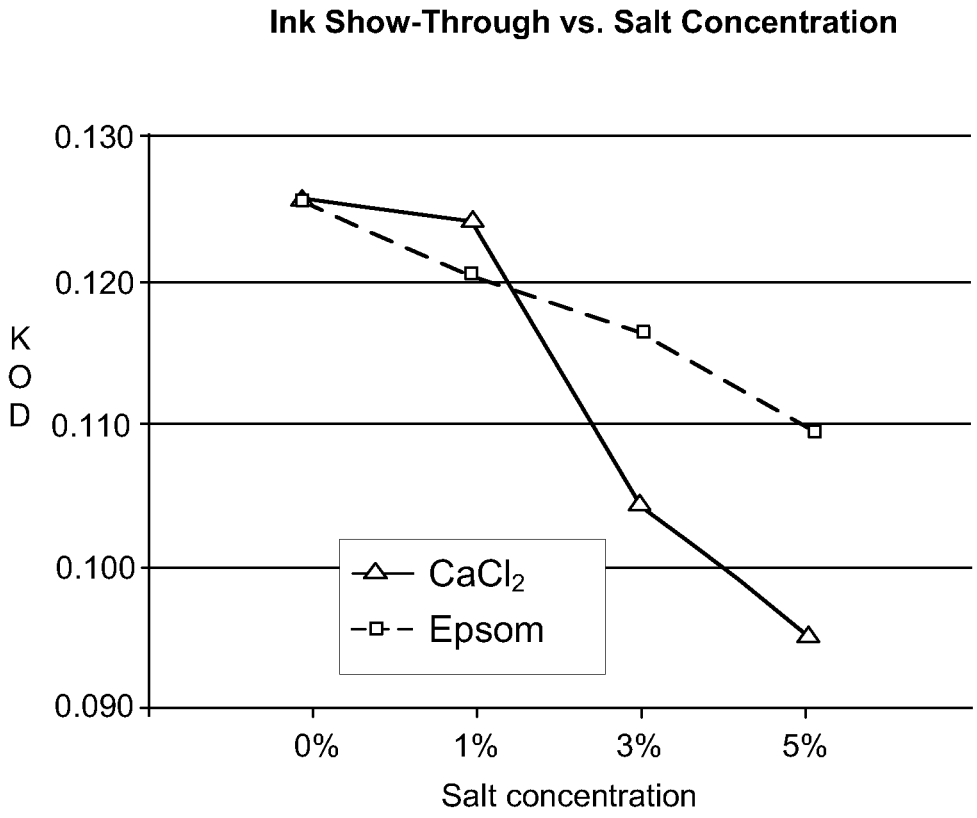
FIG. 7 is a graph of ink show-through measurements versus salt concentration for an illustrative inkjet media coated with calcium chloride and an illustrative inkjet media coated with heptahydrate epsomite salt, according to one example of principles described herein.

FIG. 7 is a graph of ink show-through measurements versus salt concentration for illustrative inkjet media surface treated with calcium chloride and heptahydrate epsomite salt. Ink show-through is the color intensity of an image that is observed from the back side of the sheet measured as an optical density. For ink show-through, a low optical density value is desirable.

The vertical axis of the graph shows the optical density of black ink (KOD) starting at 0.090 and going to 0.130. The horizontal axis shows the salt concentration in the coating, with the balance being sizing agent. The graph shows data for an inkjet medium surface treated with calcium chloride ($CaCl_2$) and inkjet medium surface treated with heptahydrate epsomite salt. As discussed above, the optical density measurements of the inkjet medium surface treated with calcium chloride are shown as triangles connected by a solid line. The optical density measurements for the inkjet medium coated with heptahydrate epsomite salt is shown as squares connected by a dashed line.

Where the salt concentration is 0%, the ink show-through is about 0.125 for both inkjet mediums. With a one percent salt concentration, the calcium chloride treated inkjet medium had an optical density of about 0.124, while the heptahydrate epsomite salt treated inkjet medium had an optical density of about 0.120. At 3% salt concentration, the calcium chloride treated inkjet medium had an optical density of a little over 0.105, while the heptahydrate epsomite salt treated inkjet medium had an optical density of about 0.117. At 5% salt concentration, the calcium chloride treated inkjet medium had an optical density of a little over 0.095, while the heptahydrate epsomite salt treated inkjet medium had an optical density of about 0.110.

This data shows that at low salt concentrations, ink show-through of the heptahydrate epsomite salt coating is comparable to the calcium chloride coating. However, as the salt concentration increases, the difference ink show-through between the calcium chloride and heptahydrate epsomite salt increases. The ink show-through steadily improves as the amount of heptahydrate epsomite salt increases.

In other examples, the heptahydrate epsomite salt may be combined with a divalent metal salt for increased performance. As discussed above, this combination of salts has a ratio of sulfate anions to chloride anions from about 5:1 to 1:1. Additionally, some cationic material may also be included in the coating. The sulfate anions are not as aggressive as the chloride anions and act as a corrosion inhibitor for chloride related pitting. This inhibiting effect is particularly pronounced if sulfate is present in molar excess over chlorides. For example, epsom salt can be used to replace between 50% to 100% of the chloride metal salt in a coating formulation.

In conclusion, including heptahydrate epsomite salt in an inkjet coating formulation reduces or eliminates the chloride ions in a paper mill's surface sizing formulation and white water. The corrosion of the paper mill machinery is reduced while the image quality performance of the inkjet media is maintained.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. An inkjet medium comprising:

a substrate;

a coating layer comprising heptahydrate epsomite, a chloride metal salt, and a surface sizing additive, the coating layer being deposited on the substrate and having a substantially uniform distribution of heptahydrate epsomite throughout its volume, the coating layer comprising sulfate anions in molar excess over chloride anions.

2. The inkjet medium of claim 1, in which the surface sizing additive comprises at least one of: starch, filler, and polymeric surface sizing agent.

3. The inkjet medium of claim 1, in which the coating layer has a ratio of sulfate anions to chloride anions from approximately 5:1 to 1:1.

4. The inkjet medium of claim 1, in which the dry coatweight of the coating layer is approximately 0.5 to 10 grams per square meter of inkjet medium, the coating layer comprising approximately 0.1 to 2.0 grams per square meter of heptahydrate epsomite.

5. The inkjet medium of claim 1, in which the dry coatweight of the coating layer is approximately 1 to 5 grams per square meter of inkjet medium, the coating layer comprising approximately 0.2 to 1.0 grams per square meter of heptahydrate epsomite.

6. The inkjet medium of claim 1, in which the heptahydrate epsomite and chloride metal salt together are present in the coating layer at a concentration of about 5% or greater by weight.

7. The inkjet medium of claim 6, in which the ratio of heptahydrate epsomite to chloride metal salt is about 90:10 by weight.

8. The inkjet medium of claim 1, in which the chloride metal salt is calcium chloride.

9. A method of producing the inkjet media of claim 1, the method comprising:

dissolving heptahydrate epsomite salt in a coating solution comprising at least one surface sizing additive; and coating at least one side of the substrate with the coating solution to produce the coating layer of the inkjet media.

10. The method of claim 9, in which the coating solution has a pH below 7.

11. The method of claim 9, in which the coating solution has pH range of between approximately 6 to 7.

12. The method of claim 9, further comprising dissolving a divalent chloride salt in the coating solution.

13. The method of claim 12, in which the coating solution has a ratio of sulfate anions in molar excess over chloride anions.

14. The method of claim 12, in which the weight percentage of the heptahydrate epsomite is more than 50% of total salts in the coating solution.

15. The method of claim 12, in which the coating solution has a ratio of sulfate anions to chloride anions of 5:1 to 1:1.

16. The method of claim 9, comprising coating a second side of the substrate with the coating solution.

17. A method for reducing corrosion during production of the inkjet media of claim 10, wherein the method comprises:

dissolving heptahydrate epsomite and a divalent chloride metal salt in a coating solution such that the coating solution comprises a ratio of sulfate anions in molar excess over chloride anions;

coating both sides of the substrate with the coating solution to produce the coating layer; and drying the coated substrate.

* * * * *